US005544591A

United States Patent [19]

Taillon

[11] Patent Number: 5,544,591

[45] Date of Patent: Aug. 13, 1996

[54] STABILIZED ROLLER BEARING ADAPTER

[75] Inventor: Armand P. Taillon, Chicago, Ill.

[73] Assignee: Standard Car Truck Company, Park Ridge, Ill.

[21] Appl. No.: 365,413

[22] Filed: Feb. 24, 1995

[51] Int. Cl.[6] ..... B61F 5/32

[52] U.S. Cl. ..... 105/223; 105/218.1

[58] Field of Search ..... 105/218.1, 220, 105/222, 223, 225; 384/158, 183, 184, 185, 191.1, 191.4

[56] References Cited

U.S. PATENT DOCUMENTS

| | | | |
|---|---|---|---|
| 1,902,823 | 3/1933 | Bender | 105/223 |
| 1,953,103 | 4/1934 | Buckwalter | 105/223 |
| 2,762,317 | 9/1956 | Palmgren | 105/223 |
| 3,274,955 | 9/1966 | Thomas | 105/224.1 |
| 3,302,589 | 2/1967 | Williams | 105/222 |
| 3,670,660 | 6/1972 | Weber et al. | 105/171 |
| 3,699,897 | 10/1972 | Sherrick | 105/218.1 |
| 3,844,226 | 10/1974 | Brodeur et al. | 105/222 |
| 3,897,736 | 8/1975 | Tack | 105/223 |
| 4,179,995 | 12/1979 | Day | 105/223 |
| 4,363,278 | 12/1982 | Mulcahy | 105/218.1 |
| 4,552,074 | 11/1985 | Mulcahy et al. | 105/224.1 |
| 4,674,412 | 6/1987 | Mulcahy et al. | 105/224.1 |
| 5,009,521 | 4/1991 | Wiebe | 105/224.1 |
| 5,226,369 | 7/1993 | Weber | 105/206.1 |

*Primary Examiner*—S. Joseph Morano
*Attorney, Agent, or Firm*—Dorn, McEachran Jambor & Keating

[57] ABSTRACT

A rail car truck has a pair of side frames, a pair of wheelsets and roller bearing adapters seated on each end of each wheelset and supporting the pedestal of the side frames. Each roller bearing adapter has an upward transverse projection and each side frame pedestal has a downward facing concave depression, with the cooperating projections and depressions resisting unsquaring relative movement between the wheelsets and side frames.

5 Claims, 4 Drawing Sheets

Fig.1.
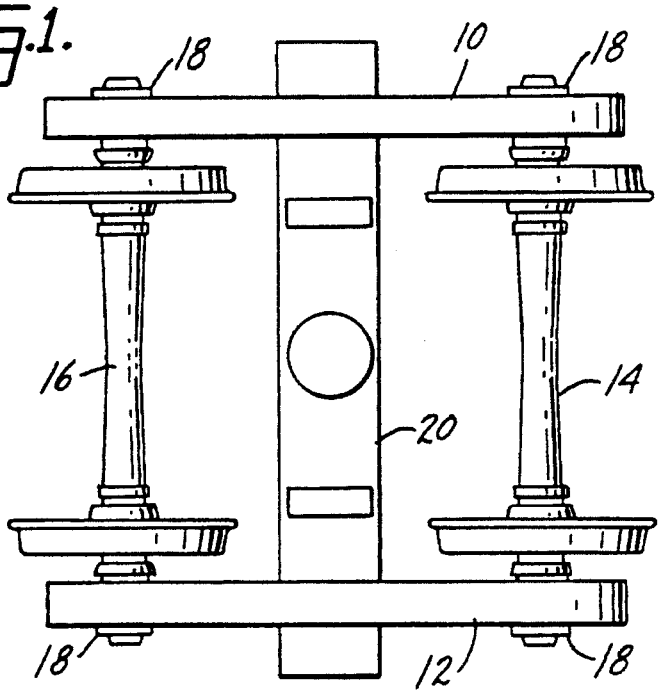
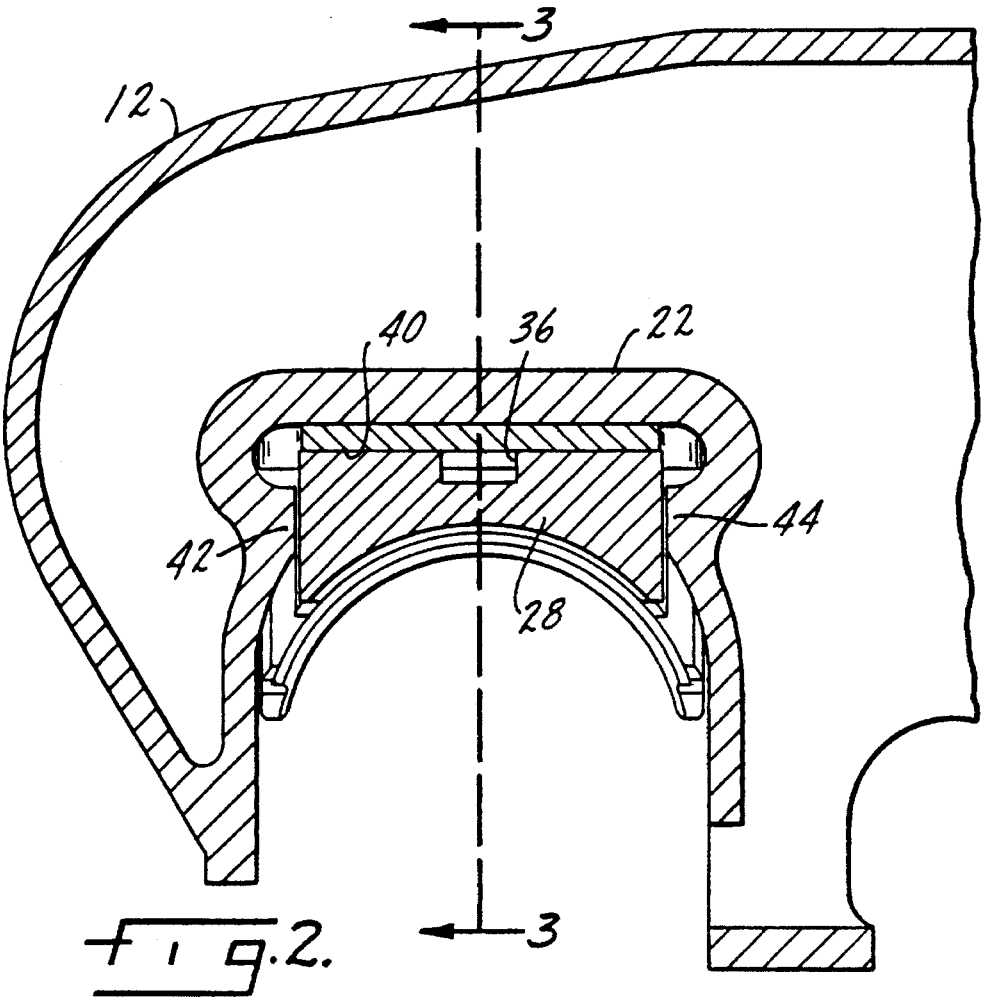
Fig.2.

Fig. 3.
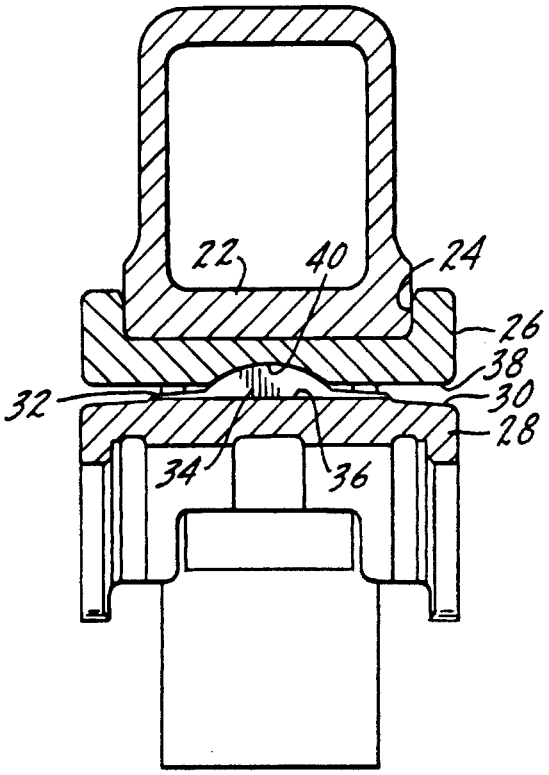
Fig. 5.
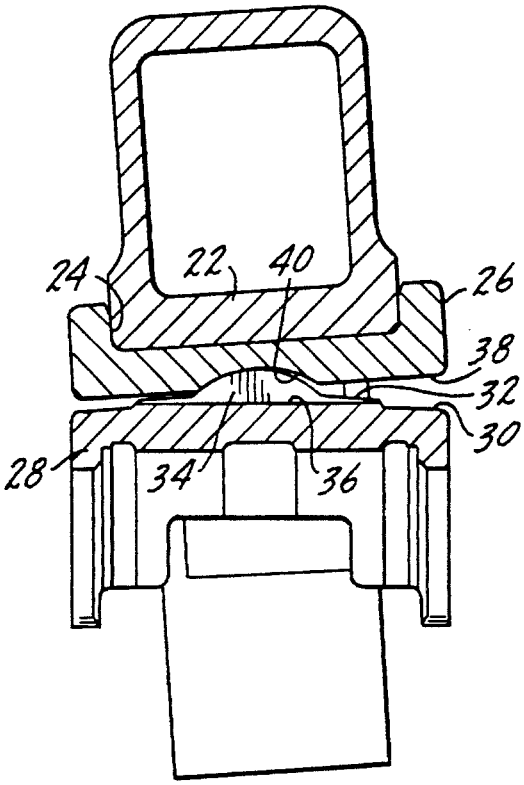
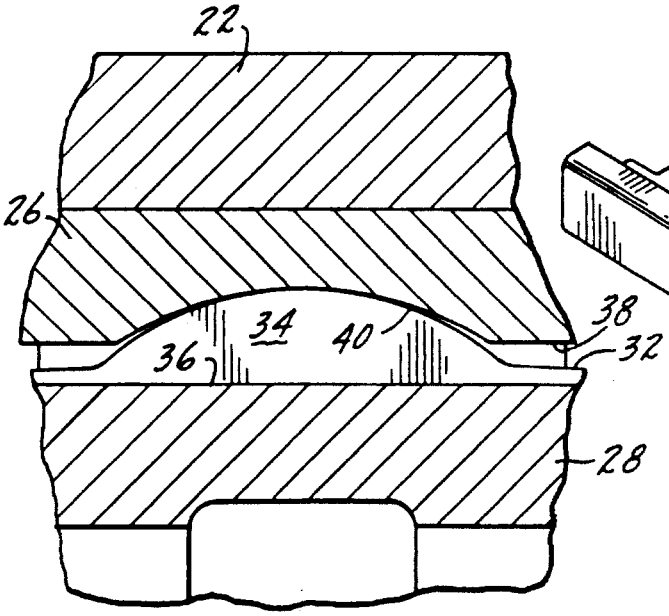
Fig. 4.
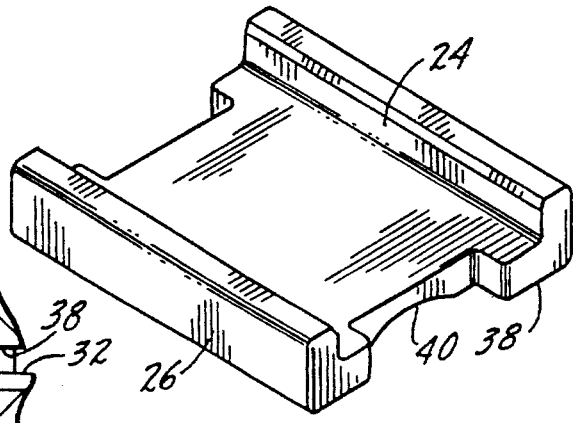
Fig. 6.

Fig. 7.
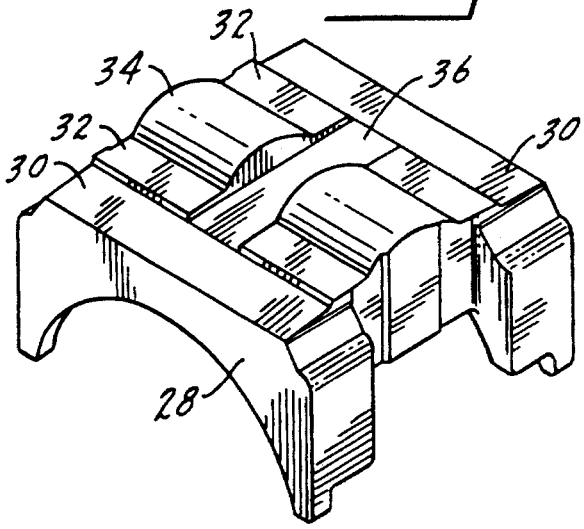
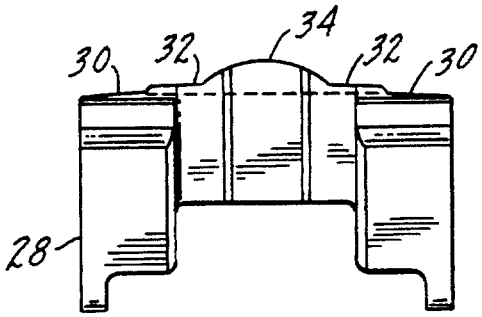
Fig. 8.
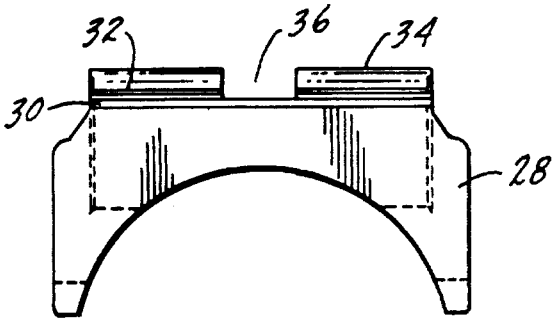
Fig. 9.
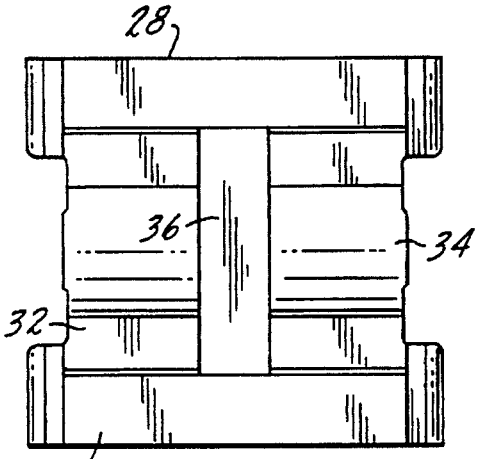
Fig. 10.

STABILIZED ROLLER BEARING ADAPTER

THE FIELD OF THE INVENTION

The testing of conventional freight car truck designs in the last few years has shown that most of the interaxle stiffness which governs performance of the truck is attributable to the side frame pedestal to roller bearing adapter connection. However, this connection has an inherent problem in that it only provides stiffness, resisting unsquaring movement between the side frames and wheelsets to the point where the forces applied cause it to break free from static to kinematic friction. The elimination of the kinematic friction at this support point in the rail car truck would greatly increase its warp stiffness or resistance to unsquaring movement between the side frames and wheelsets.

Although it is important to increase warp stiffness, this must be done in a way as to insure maximum life of the wheelset roller bearings. A potential cause of roller bearing failure is eccentric loading due to the rolling motion between the side frame and the roller bearing adapter. The present invention increases the warp stiffness or the resistance to unsquaring truck movement and protects the roller bearing by permitting a limited degree of rolling motion between the roller bearing adapter and the side frame.

The invention provides an upwardly facing projection on the roller bearing adapter and a downwardly facing depression on the pedestal of the side frame. The depression may be in the side frame pedestal or in an interface plate which is between the roller bearing adapter and the side frame pedestal. The projection and cooperating depression provide restraint on lateral and yaw movement between the side frame and the roller bearing adapter resisting unsquaring movements of the truck.

SUMMARY OF THE INVENTION

The present invention relates to freight car trucks and in particular to a freight car truck which increases warp stiffness while permitting a degree of rolling movement between the side frame and the wheelset, which prevents eccentric loads from being applied to the roller bearing.

Another purpose of the invention is a side frame/wheelset support system for a rail car truck which resists unsquaring movement between the wheelsets and side frames, and permits rolling motion of the side frames relative to the wheelsets on an axis transverse to the wheelsets.

Another purpose is the combination of a roller bearing adapter and interface plate used in the mounting of a side frame on a wheelset roller bearing which permits a degree of rolling motion therebetween.

Another purpose is a side frame/wheelset support system as described which is suitable both in retrofitting existing freight car trucks and for new truck manufacture.

Other purposes will appear in the ensuing specification, drawings and claims.

BRIEF DESCRIPTION OF THE DRAWINGS

The invention is illustrated diagrammatically in the following drawings wherein:

FIG. 1 is a plan view of a freight car truck of the type described herein;

FIG. 2 is an enlarged side view of the side frame, side frame pedestal, roller bearing adapter and interface plate;

FIG. 3 is a section along plane 3—3 of FIG. 2;

FIG. 4 is an enlarged section illustrating the relationship between the roller bearing adapter, interface plate and side frame pedestal;

FIG. 5 is a view similar to FIG. 3 showing the side frame and interface plate slightly rolled relative to the vertical position of the roller bearing adapter;

FIG. 6 is a top perspective of the interface plate;

FIG. 7 is a top perspective of the roller bearing adapter;

FIG. 8 is a side view of the roller bearing adapter;

FIG. 9 is a front view of the roller bearing adapter;

FIG. 10 is a top view of the roller bearing adapter;

DESCRIPTION OF THE PREFERRED EMBODIMENT

The present invention relates to freight car trucks and specifically to an improved mounting for the side frame which will improve performance in stability and curving. The truck design disclosed herein will increase warp stiffness or interaxle shear stiffness or the resistance to the unsquaring forces which are applied to the truck during high speed operation and curving. The manner in which the side frame pedestal is mounted upon the roller bearing reduces the potential for longitudinal, lateral and yaw movement between these elements. It also permits a limited amount of rolling motion, on an axis transverse to that of the wheelset, between the roller bearing adapter and the side frame which protects the roller bearing from premature failure due to constant eccentric loading.

In a conventional three piece freight car truck the interaxle stiffness which controls stability and curving performance is contributed mostly by the side frame pedestal to roller bearing adapter connection. The problem with this connection is that it only provides stiffness up to the point where the forces cause it to break free from static to kinematic friction. By eliminating the kinematic portion of the connection's characteristics, it is possible for a conventional freight car truck to approach that of a radial truck in terms of stability and curving performance. The present invention provides a connection between the side frame pedestal and the roller bearing adapter which increases warp stiffness while permitting a desired degree of rolling movement between the side frame and the roller bearing adapter.

Figure 11:
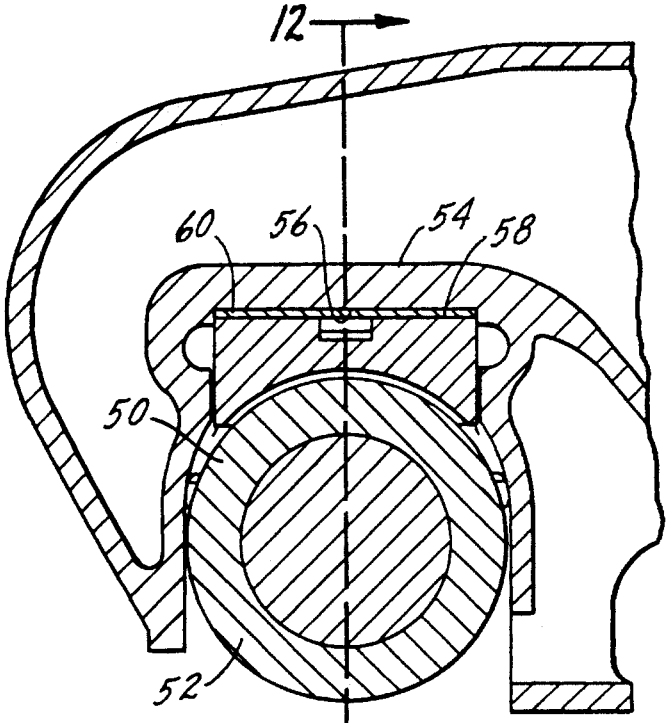
FIG. 11 is an enlarged side view of the side frame, side frame pedestal, and roller bearing adapter of a second embodiment of the invention.
Figure 12:
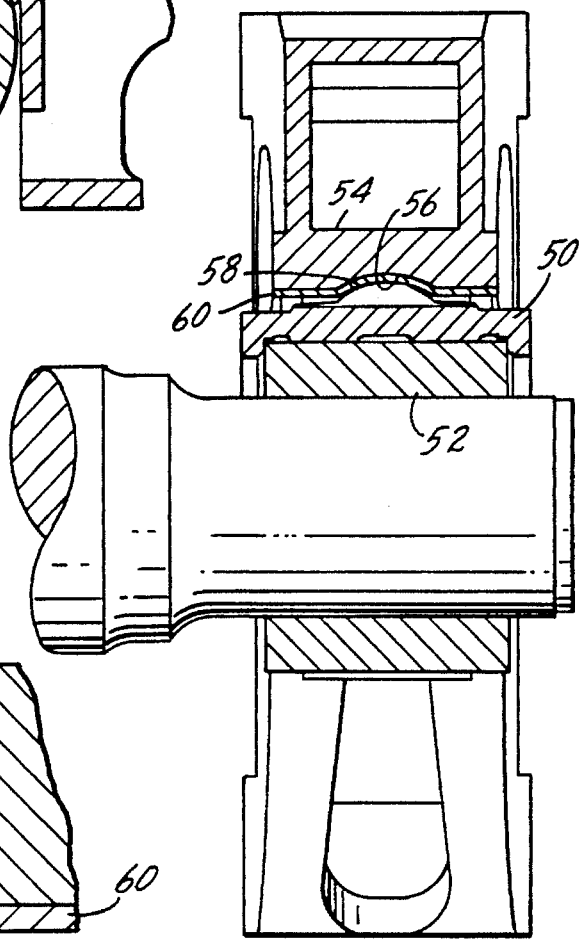
FIG. 12 is a section along plane 12—12 of FIG. 11.
Figure 13:
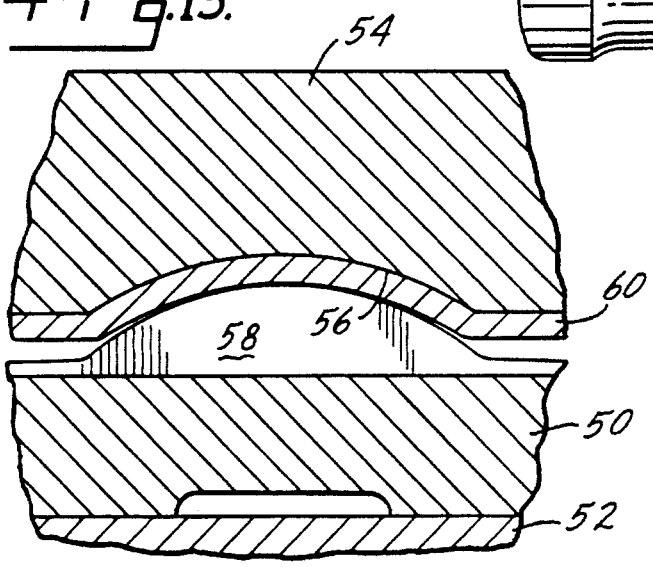
FIG. 13 is an enlarged section illustrating the relationship between the roller bearing adapter and side frame pedestal of the FIG. 11 embodiment.

In FIG. 1 a typical freight car truck includes a pair of side frames 10 and 12, each of which mounts wheelsets 14 and 16. Each of the wheelsets has roller bearings indicated at 18 and the side frames are seated upon the roller bearings in a manner to be described. The conventional truck is completed by a bolster 20 which normally will be spring supported in windows of the side frames 10 and 12. The present invention will be described both as a retrofit (FIGS. 2–6) and for new truck manufacture (FIGS. 11–13).

Looking specifically at FIGS. 2 and 3, which illustrate one side frame to wheelset interconnection, the side frame has a pedestal indicated at 22 which is seated within a recess 24 of an interface plate 26. As illustrated in FIG. 3, the width of the interface plate recess 24 is approximately that of the pedestal preventing lateral and yaw movement therebetween. It is essential that this connection be stiff and in some instances may require welding. By the described connection the side frame is restrained from lateral and yaw movement relative to the interface plate, roller bearing and wheelset.

There is a roller bearing adapter 28 which has a lower surface configured to fit closely about the roller bearing illustrated at 18 in FIG. 1. This is a conventional construction. The roller bearing adapter 28 has an upper surface 30, with a generally central raised area 32 which forms an essentially planar surface, with the center portion thereof having a raised arcuate projection 34. The arcuate projection 34 extends transversely across substantially the entire upper surface 32 of the roller bearing adapter 28 with the exception of a generally centrally located notch 36 which is A.A.R. specified for roller bearing adapters to reduce the concentration of load at the center of the roller bearing.

The interface plate 26 has a lower planar surface 38 with a transverse concave depression 40 which extends generally the full width of the surface 38. The relationship between the depression 40 and the projection 34 is important in terms of restraining yaw movement. If these elements are too small, there will not be adequate strength to resist the rather large potential yaw forces. If these elements are too large, they will allow slippage to occur, thus not achieving their purpose. As an example, but without limitation, the radius of the projection 34 may be 2" and that of the depression 40 may be 2.25". The radius of each of these two elements may be substantially different from the above example, as what is important is the relationship between the radii. The radius on the depression 40 must be greater than that on the projection 34. However, if the radius on the depression is substantially greater than that of the projection, there will be an unacceptable amount of stress concentration on the top of the projection which may materially affect the life of the roller bearing adapter and/or interface plate. On the other hand, if there is not a sufficient difference between the radii of these two interlocking elements, excessive friction will prevent the desired degree of rolling movement between the side frame and the roller bearing. The described relationship of approximately 1 to 1.125 has been found to be satisfactory, but the invention should not be limited thereto.

The space between the planar surfaces 32 and 38, as illustrated in FIGS. 3 and 5, is such as to permit a roll angle of at least 3.5°. Normally, these surfaces will not be in contact during rolling movement between the side frame and the wheelset, as other elements of the car truck structure will limit such rolling movement prior to the time of contact between these two surfaces. Note also that with such a roll angle, the roller bearing adapter retains its essentially vertical orientation thereby applying no eccentric load on the roller bearing.

As indicated above, relative lateral movement between the side frame pedestal and the interface plate is restricted by the recess 24 within which the pedestal is seated. As shown particularly in FIG. 2, the side frame pedestal has inwardly directed side portions 42 and 44, on opposite sides thereof, which closely adjoin the opposite ends of the roller bearing adapter. This relationship is conventional and restrains the roller bearing adapter against lateral movement and provides a gauge for measuring and matching side frames.

FIGS. 11, 12 and 13 illustrate the invention for new truck construction. A roller bearing adapter 50 is seated upon a roller bearing 52 and is of the same construction as illustrated in FIGS. 7–10. The side frame pedestal 54 has a concave depression 56 which will have the same size relationship with the roller bearing adapter projection 58 as described in the earlier embodiment. To protect the side frame pedestal from wear a wear plate 60 may be welded thereto, with the wear plate conforming to the pedestal face opposed to the roller bearing adapter.

Both embodiments will function in the same manner. The roller bearing adapter projection and its cooperating concave depression in either the side frame pedestal or the interface plate will prevent lateral and yaw movement between these elements, thus resisting the unsquaring forces applied to the truck during high speed operations and curving.

Whereas the preferred form of the invention has been shown and described herein, it should be realized that there may be many modifications, substitutions and alterations thereto.

The embodiments of the invention in which an exclusive property or privilege is claimed are defined as follows:

1. A rail car truck having a pair of side frames, a pair of wheelsets, each wheelset having an axis transverse to the side frames, a roller bearing adapter seated on each end of each wheelset and each roller bearing adapter having an axis parallel to a respective said wheelset axis, each side frame having a pedestal at each end thereof, with each pedestal being formed and adapted to seat on a respective said roller bearing adapter, each roller bearing adapter having an upper surface facing a respective said side frame pedestal, with each roller bearing adapter upper surface having a planar portion and an arcuate projection extending upwardly therefrom, each such arcuate projection extending transverse to the roller bearing adapter axis, each side frame pedestal having surface means facing said roller bearing upper surface, which surface means has a planar portion and a concave depression, each roller bearing adapter projection extending into a respective said side frame pedestal surface means concave depression to thereby provide resistance to unsquaring relative movement between the wheelsets and side frames, the radius of each concave depression being greater than the radius of each arcuate projection, the planar surface portions on each roller bearing adapter and each side frame pedestal surface means being normally spaced with the space therebetween permitting limited rolling movement between a respective said side frame and wheelset before there is contact between said roller bearing adapter surface planar portion and said side frame pedestal surface means planar portion.

2. The rail car truck of claim 1 wherein the radius of each concave depression is on the order of about 12½% greater than the radius on each roller bearing adapter projection.

3. The rail car truck of claim 1 wherein each side frame pedestal surface means includes a wear plate positioned on each side frame pedestal, each side frame pedestal having a surface facing the roller bearing adapter surface, which side frame pedestal surface has a planar portion and a concave depression, each wear plate having an upper surface conforming generally with said side frame pedestal surface facing the roller bearing adapter surface.

4. The rail car truck of claim 1 wherein each side frame pedestal surface means includes an interface plate positioned between the side frame pedestal and the upwardly facing roller bearing adapter surface, each interface plate having a concave depression, with the roller bearing adapter projection extending into said concave depression, each interface plate further having a planar surface portion facing the planar surface portion of the roller bearing adapter.

5. The rail car truck of claim 4 wherein each interface plate has a recess on an upper surface thereof, each side frame pedestal extending into an interface plate recess, with the size and shape of each interface plate recess precluding relative side frame/wheelset lateral and yaw movement.

* * * * *